US007740924B2

(12) United States Patent
Iwasa et al.

(10) Patent No.: US 7,740,924 B2
(45) Date of Patent: Jun. 22, 2010

(54) LABELED RESIN CONTAINER

(75) Inventors: Yasuo Iwasa, Ibaraki (JP); Takatoshi Nishizawa, Ibaraki (JP)

(73) Assignee: Yupo Corporation, Tokyo (JP)

( * ) Notice: Subject to any disclaimer, the term of this patent is extended or adjusted under 35 U.S.C. 154(b) by 0 days.

(21) Appl. No.: 11/024,779

(22) Filed: Dec. 30, 2004

(65) Prior Publication Data

US 2005/0276943 A1 Dec. 15, 2005

Related U.S. Application Data

(63) Continuation-in-part of application No. PCT/JP2004/008558, filed on Jun. 11, 2004.

(51) Int. Cl.

| | |
|---|---|
| ***B29D 22/00*** | (2006.01) |
| ***B32B 15/08*** | (2006.01) |
| ***B32B 27/00*** | (2006.01) |
| ***B32B 27/08*** | (2006.01) |
| ***B65D 81/00*** | (2006.01) |
| ***B65D 85/00*** | (2006.01) |

(52) U.S. Cl. ..... 428/35.7; 206/521; 428/34.1; 428/34.3; 428/35.9; 428/36.92; 428/41.3; 428/42.3

(58) Field of Classification Search ..... 428/35.7, 428/34.1, 34.3, 35.9, 41.3, 42.3, 36.92; 206/521
See application file for complete search history.

(56) References Cited

U.S. PATENT DOCUMENTS 5,223,315 A * 6/1993 Katsura et al. ..... 428/36.92
6,551,671 B1 * 4/2003 Nishizawa et al. ..... 428/34.1
2003/0099793 A1 * 5/2003 Dronzek, Jr. ..... 428/35.7

FOREIGN PATENT DOCUMENTS

| | | | |
|---|---|---|---|
| EP | 1302300 | A1 * | 4/2003 |
| JP | 8-142171 | | 6/1996 |
| JP | 8-254956 | | 10/1996 |
| JP | 2000-72931 | | 3/2000 |
| JP | 2000071320 | A * | 3/2000 |
| JP | 2000-219227 | | 8/2000 |
| JP | 2000-239480 | | 9/2000 |
| JP | 2000-254959 | | 9/2000 |
| JP | 2000-319407 | | 11/2000 |
| JP | 2002-36345 | | 2/2002 |
| JP | 2002-52601 | | 2/2002 |
| JP | 2002-187996 | | 7/2002 |
| JP | 2002-187997 | | 7/2002 |
| JP | 2003-72731 | | 3/2003 |
| WO | WO 2005/120963 | A1 | 12/2005 |

OTHER PUBLICATIONS

Translation of JP 2000071320 A (Fukuhara), see above.*

* cited by examiner

*Primary Examiner*—Brent T O'Hern
(74) *Attorney, Agent, or Firm*—Oblon, Spivak, McClelland, Maier & Neustadt, L.L.P.

(57) ABSTRACT

Disclosed is an in-mold labeled thermoplastic resin container specifically so designed that the ratio of the product A of the Gurley stiffness (m·kgf) and the 3% elongation load (kgf) of the label-edge part of the labeled area thereof to the product B of the Gurley stiffness and the 3% elongation load of the label-surrounding part of the non-labeled area thereof, A/B, is at most 0.6. The container has good drop impact fracture resistance and has good producibility, and it is lightweight.

17 Claims, 2 Drawing Sheets

LABELED RESIN CONTAINER

The present application is a continuation-in-part of PCT/JP2004/008558 filed on Jun. 11, 2004.

BACKGROUND OF THE INVENTION

1. Field of the Invention

The present invention relates to a labeled resin container having improved drop impact fracture resistance, and concretely to an in-mold labeled resin container.

2. Description of the Related Art

With the increase in their size, resin containers are required to be lightweight. In in-mold labeled containers, however, the impact strength of the label-surrounded part is lower than that of the other part. Therefore, when such containers drop down from a high place such as a shelf thereof to reach the ground, then they may be broken, starting from the label-surrounded part thereof owing to the drop impact given thereto, and, as a result, there occurs a problem in that their contents may leak out. For improving the drop impact strength of the containers, for example, it has been proposed to specifically define the MFR and the degree of crystallinity of the resin to be used for the containers (e.g., JP-A 2000-72931, 2000-219227, 2000-239480, 2000-254959, 2000-319407, 2002-52601, 2002-187996, 2002-187997). However, in some combinations with the in-mold label to be used for them, the drop impact strength of the containers could not be still satisfactorily improved even though the physical properties of the resin to be used for the containers are specifically defined in various points. In particular, large-size containers with the contents therein are extremely heavy as a whole. Therefore, according to the proposed method, the breakage of the containers starting from the label-surrounded part thereof could not be sufficiently prevented.

In consideration of the problems with the related art as above, an object of the present invention is to provide a labeled resin container which is lightweight and has good producibility and which is improved in point of the drop impact fracture resistance thereof.

SUMMARY OF THE INVENTION

We, the present inventors have assiduously studied so as to attain the above-mentioned object, and, as a result, have found that a labeled resin container, of which the ratio of the mechanical strength of the labeled area to the mechanical strength of the non-labeled area falls within a specific range, attains the intended effect, and have reached the present invention.

Specifically, the invention provides a labeled resin container with an in-mold label fitted thereto, which has the constitution mentioned below.

(1) An in-mold labeled thermoplastic resin container, wherein the ratio of the product A of the Gurley stiffness (m·kgf) and the 3% elongation load (kgf) of the label-edge part of the labeled area to the product B of the Gurley stiffness and the 3% elongation load of the label-surrounding part of the non-labeled area, A/B, is at most 0.6.

(2) The labeled resin container of (1), wherein A/B is at most 0.55.

(3) The labeled resin container of (1) or (2), wherein the product of A/B and the cross-sectional area S ($\mu m^2$) of the notch occurring in the boundary between the label and the resin container, (A/B)×S, is less than $1.0\times10^4$ $\mu m^2$.

(4) The labeled resin container of any of (1) to (3), wherein the thermoplastic resin container contains a polyolefin-based resin.

(5) The labeled resin container of (4), wherein the polyolefin-based resin is a polyethylene-based resin or a polypropylene-based resin.

(6) The labeled resin container of any of (1) to (5), wherein the volume of the thermoplastic resin container is at least 1.5 liters.

(7) The labeled resin container of any of (1) to (6), wherein the in-mold label has a heat-seal resin layer (B) formed on one surface of the thermoplastic resin-containing substrate layer (A) thereof, and it is integrally fitted to the thermoplastic resin container via the heat-seal resin layer (B).

(8) The labeled resin container of (7), wherein the thermoplastic resin-containing substrate layer (A) is of a stretched resin film that contains from 30 to 100% by weight of a thermoplastic resin and from 0 to 70% of an inorganic fine powder and/or an organic filler.

(9) The labeled resin container of (7) or (8), wherein the substrate layer (A) is monoaxially stretched.

(10) The labeled resin container of (7) or (8), wherein the substrate layer (A) is biaxially stretched.

(11) The labeled resin container of (7) or (8), wherein the substrate layer (A) is a combination of a biaxially-stretched layer and a monoaxially-stretched layer.

(12) The labeled resin container of any of (9) to (11), wherein the heat-seal resin layer (B) is stretched at least one direction.

(13) The labeled resin container of any of (9) to (11), wherein the opacity of the in-mold label is from 70 to 100%.

(14) The labeled resin container of any of (9) to (11), wherein the opacity of the in-mold label is from 0 to less than 70%.

(15) The labeled resin container of any of (9) to (11), wherein the heat-seal resin layer (B) is formed in a coating method.

(16) The labeled resin container of any of (9) to (15), wherein the surface of the substrate layer (A) is coated with a coating layer and/or a metal layer.

(17) The labeled resin container of any of (9) to (16), wherein the in-mold label has a print layer.

(18) The labeled resin container of any of (7) to (17), wherein the heat-seal resin layer (B) is embossed.

(19) The labeled resin container of any of (1) to (18), wherein the in-mold label contains a polyolefin-based resin.

(20) The labeled resin container of any of (1) to (19), wherein the corners of the in-mold label each have a radius of curvature of at least 5 mm.

(21) The labeled resin container of any of (1) to (20), wherein the edge profile of the in-mold label meets the label face not at a right angle but at an acute angle to reduce the notch area.

(22) The labeled resin container of any of (1) to (21), wherein the in-mold label is so fitted to the container that the direction of the label having a lower Gurley stiffness is to be vertical to the breaking direction of the container that breaks owing to the drop impact applied thereto.

(23) A method for producing a labeled resin container in a mode of blow-molding, wherein the ratio of the product A of the Gurley stiffness and the 3% elongation load of the label-edge part of the labeled area of the container to the product B of the Gurley stiffness and the 3% elongation load of the label-surrounding part of the non-labeled area thereof, A/B, is at most 0.6.

Figure 1:
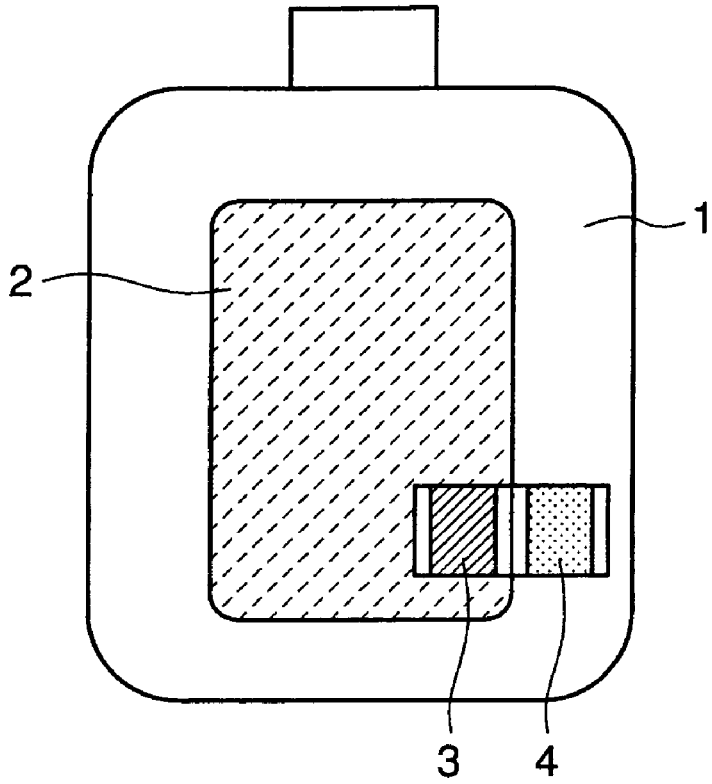
FIG. 1 is a side view showing one example of the labeled resin container of the invention.

In the drawings, 1 is a container; 2 is an in-mold label; 3 is a label-edge part; 4 is a label-surrounding part; S is a notch cross-section area.

BEST MODE FOR CARRYING OUT THE INVENTION

The labeled resin container of the invention, which is so constituted that the label is integrally fitted to the resin container body, is described hereinunder in point of the resin container and the label in order. In this description, the numerical range expressed by the wording "a number to another number" means the range that falls between the former number indicating the lowermost limit of the range and the latter number indicating the uppermost limit thereof.

Labeled Resin Container

The labeled resin container of the invention is so designed that the ratio of the product A of the Gurley stiffness (m·kgf) and the 3% elongation load (kgf) of the label-edge part of the labeled area thereof to the product B of the Gurley stiffness and the 3% elongation load of the label-surrounding part of the non-labeled area thereof, A/B, is at most 0.6, preferably at most 0.55, more preferably from 0.05 to 0.50. If it is over 0.6, then the drop impact strength of the container significantly lowers.

The "label-edge part" as referred to herein means a rectangular part that is defined to include a virtual line, as one side thereof, drawn in parallel to the edge of the label positioned 5 mm inside from the label edge. Concretely, it indicates a rectangular part cut out of the label to have an area of 5 cm of the virtual line parallel to the edge and 3 cm in the direction perpendicular to it (see the label-edge part 3 in FIG. 1 and FIG. 2). The resin container with such a rectangular label part fitted thereto is cut out as a test piece, and this is tested according to the methods described in the following Examples, whereby the Gurley stiffness (m·kgf) and the 3% elongation load (kgf) of the label-edge part of the resin container can be determined.

The "label-surrounding part" as referred to herein means a rectangular part that is defined to include a virtual line, as one side thereof, drawn in parallel to the edge of the label positioned 5 mm outside from the label edge and moved toward the non-labeled area. Concretely, it indicates a rectangular part cut out of the non-labeled region to have an area of 5 cm of the virtual line parallel to the edge and 3 cm in the direction perpendicular to it (see the label-surrounding part 4 in FIG. 1 and FIG. 2). The rectangular resin container of that part is cut out as a test piece, and this is tested according to the methods described in the following Examples, whereby the Gurley stiffness (m·kgf) and the 3% elongation load (kgf) of the label-surrounding part of the resin container can be determined.

Figure 2:
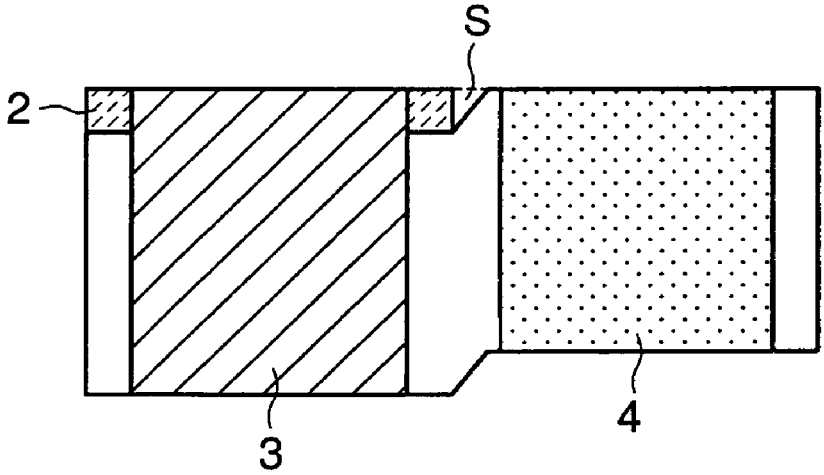
FIG. 2 is a partly cross-sectional view of one example of the labeled resin container of the invention.
Figure 3:
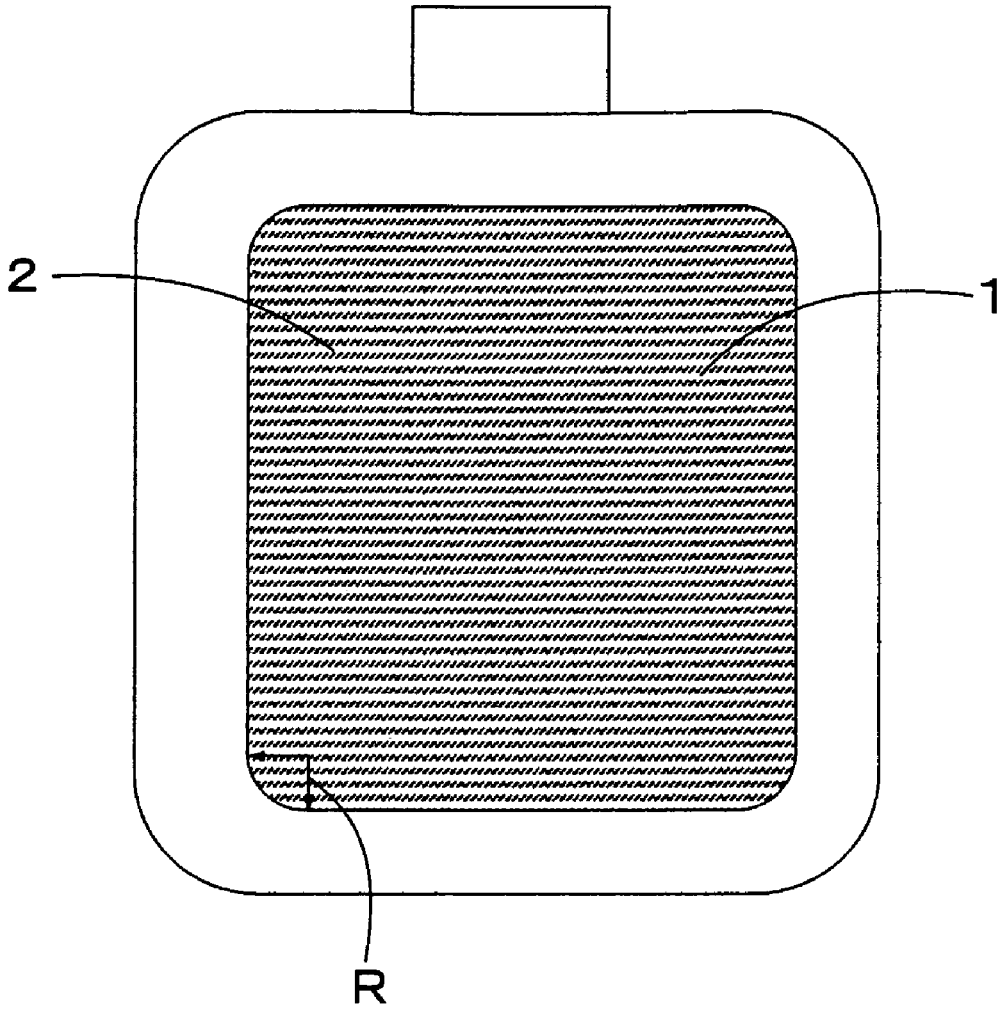
FIG. 3 is a side view of one example of the labeled resin container of the invention, indicating the radius of curvature R at the corner of the label.

The cross section of the in-mold labeled resin container generally has a structure as in FIG. 2. Specifically, a notch is formed between the labeled part and the non-labeled part. The labeled resin container of the invention may be so designed that the product of A/B and the cross-sectional area S ($\mu m^2$) of the notch, (A/B)×S, is less than $1.0\times10^4$ $\mu m^2$, preferably less than $0.9\times10^4$ $\mu m^2$, more preferably from more than $0.1\times10^4$ $\mu m^2$ to less than $1.0\times10^4$ $\mu m^2$. If it is $1.0\times10^4$ $\mu m^2$ or more, then the notch will be extremely large and the drop impact strength of the container may lower. The cross section S of the notch may be determined according to the method described in the following Examples.

Resin Container

The material of the container is not specifically defined. For example, herein usable are ethylene homopolymers such as high-density polyethylene, middle-density polyethylene, linear low-density polyethylene, ultra-low-density polyethylene polymerized by the use of a single-site catalyst; ethylene/α-olefin copolymers, as well as branched low-density polyethylene, ethylene-vinyl acetate copolymer; polyolefin-based resins such as polypropylene; and polyethylene terephthalate resins, polyethylene naphthalate resins, polyamide resins, polyvinyl chloride resins, polystyrene resins and polycarbonate resins. In addition, various blends of different types of resins including any others than the above-mentioned resins may also be used herein. Further, those including any of inorganic fillers and other modifiers as well as coloring pigments are also usable. The layer constitution may be either a single-layered one or a multi-layered one. For example, a barrier resin such as saponified ethylene-vinyl acetate copolymer or polyamide-based resin, as well as an adhesive resin for it to the main layer material may also be laminated to construct the layer constitution.

Any known blow-molding method may be employed in producing the resin container. For example, herein employable are a direct blow-molding method, an injection-stretch blow-molding method, and a pipe or sheet-extrusion stretching blow-molding method. The volume of the container is not specifically defined. However, labeled resin containers having a volume of 1.5 liters or more may be readily broken by drop impact. Therefore, the invention may enjoy more advantages when applied to labeled resin containers having a volume of 1.5 liters or more, preferably from 2 to 300 liters, more preferably from 3 to 100 liters. Containers smaller than 1.5 liters in volume are relatively light even when filled with contents, and therefore their weight may be enlarged. In other words, such small containers may have a thick wall and their drop impact energy is small, and therefore they are hardly broken.

Label

The label for use in the invention is not specifically defined in point of its type, so far as it is fittable to resin containers and may attain the intended effect. For example, one embodiment of the label is a stretched porous resin film of which the thermoplastic resin-containing substrate layer (A) comprises from 30 to 100% by weight, preferably from 35 to 99% by weight, more preferably from 38 to 97% by weight of a thermoplastic resin and contains from 0 to 70%, preferably from 1 to 65% by weight, more preferably from 3 to 62% by weight of an inorganic fine powder and/or an organic filler. The thermoplastic resin for use in the substrate layer (A) includes polyolefin-based resins, for example, polypropylene-based resins, polyethylene-based resins such as high-density polyethylene, middle-density polyethylene, low-density polyethylene; polymethyl-1-pentene, ethylene-cyclic olefin copolymers; polyamide-based resins such as nylon-6, nylon-6,6, nylon-6,10, nylon-6,12; thermoplastic polyester-based resins such as polyethylene terephthalate and its copolymers, polyethylene naphthalate, aliphatic polyesters; and other thermoplastic resins such as polycarbonates, atactic polystyrene, syndiotactic polystyrene, polyphenylene sulfide. Two or more of these may be combined for use herein.

Of those, preferred are polyolefin-based resins from the viewpoint of the chemical resistance and the production cost thereof; and more preferred are propylene-based resins. The propylene-based resins are preferably propylene homopolymers that are isotactic or syndiotactic polymers. Also usable herein are propylene-based copolymers having a different degree of stereospecificity, that are prepared through copolymerization of propylene with an α-olefin such as ethylene, 1-butene, 1-hexene, 1-heptene, 4-methyl-1-pentene. The copolymers may be binary, ternary or more polynary ones, and may also be random copolymers or block copolymers.

Also preferred for use herein are films formed of the resin and containing from 0 to 70% by weight, preferably from 1 to 65% by weight, more preferably from 3 to 62% by weight of an inorganic fine powder or an organic filler; films stretched in one or two directions in an known method; films coated with an inorganic filler-containing latex; and films coated with aluminium in a mode of vapor deposition or lamination. If desired, the films may contain any of dispersant, antioxidant, compatibilizer, UV stabilizer, antiblocking agent. The type of these additives for use herein is not specifically defined.

Examples of the inorganic fine powder that may be used in the label include heavy calcium carbonate, light calcium carbonate, calcined clay, talc, barium sulfate, diatomaceous earth, magnesium oxide, zinc oxide, titanium oxide, silicon oxide, silica; composite inorganic fine powder having an aluminium oxide or hydroxide around nuclei of a hydroxyl group-containing inorganic fine powder; and hollow glass beads. These inorganic fine powders may be subjected to surface treatment with various surface-treating agents. Above all, heavy calcium carbonate, calcined clay and talc are preferred as they are inexpensive and improve the moldability of resin. More preferred is heavy calcium carbonate.

Examples of the organic filler include polyethylene terephthalate, polybutylene terephthalate, polyamide, polycarbonate, polyethylene naphthalate, polystyrene, acrylate or methacrylate polymer and copolymer, melamine resin, polyethylene sulfite, polyimide, polyethyl ether ketone, polyphenylene sulfide, cyclic olefin homopolymer, and cyclic olefin-ethylene copolymer. Above all, preferred are the resins that have a higher melting point than the thermoplastic resin used herein and are not compatible with the thermoplastic resin. When an olefin-based resin is used, then the organic filler to be used for it is preferably selected from polyethylene terephthalate, polybutylene terephthalate, polyamide, polycarbonate, polyethylene naphthalate, polystyrene, cyclic olefin homopolymer, and cyclic olefin-ethylene copolymer.

Of the inorganic fine powder and the organic filler, more preferred is the inorganic fine powder since it produces a smaller quantity of heat when fired.

The mean particle size of the inorganic fine powder or the mean dispersion particle size of the organic filler for use in the invention is preferably from 0.01 to 30 μm, more preferably from 0.1 to 20 μm, even more preferably from 0.5 to 15 μm. In view of the easiness in mixing it with thermoplastic resin, the size of the powder or the filler is more preferably at least 0.1 μm. When the layer is stretched so as to form pores inside it to thereby improve the printability of the layer, it is desirable that the size of the powder or the filler is at most 20 μm so as to prevent the trouble of sheet breakage during stretching or to prevent the reduction in the strength of the surface layer.

One embodiment of determining the mean particle size of the inorganic fine powder for use in the invention is described. Using a particle sizer, for example, a laser diffraction-type particle sizer Microtrack (trade name by Nikkiso KK), the particles are analyzed, and the data of cumulative 50% particles are computed to obtain the mean particle size in terms of the 50% cumulative particle size of the particles. The particle size of the organic filler dispersed in thermoplastic resin by melt kneading and dispersing it in the resin may be determined as follows. The cross section of the label to be analyzed is observed with an electronic microscope, and at least 10 particles seen in the field of view are measured. Their data are averaged to obtain the mean particle size of the particles.

For the label for use in the invention, one may be selected from the above and may be used alone, or two or more may be selected and combined for use in the label. When two or more are selected, combined and used, then an inorganic fine powder and an organic filler may be combined.

When the fine powder is incorporated and kneaded in a thermoplastic resin, if desired, any of antioxidant, UV stabilizer, dispersant, lubricant, compatibilizer, flame retardant and coloring pigment may be added thereto. When the label of the invention is used as a durable material, then antioxidant, UV stabilizer and the like are preferably added thereto. When an antioxidant is added, its amount may be generally from 0.001 to 1% by weight. Concretely, heat stabilizers such as steric-hindered phenols, phosphorus-containing compounds or amine compounds may be used. When a UV stabilizer is used, its amount may be generally from 0.001 to 1% by weight. Concretely, steric-hindered amines, or benzotriazole-type or benzophenone-type light-stabilizers may be used.

The dispersant and the lubricant are used, for example, for dispersing the inorganic fine powder. Its amount generally falls between 0.01 and 4% by weight. Concretely, herein usable are silane coupling agents; higher fatty acids such as oleic acid, stearic acid; metal soap; polyacrylic acid, polymethacrylic acid and their salts. When an organic filler is used in the invention, the type and the amount of the compatibilizer to be used along with it are important factors as they may govern the particle morphology of the organic filler. Preferred examples of the compatibilizer for the organic filler are epoxy-modified polyolefins and maleic acid-modified polyolefins. The amount of the compatibilizer may be from 0.05 to 10 parts by weight relative to 100 parts by weight of the organic filler.

Not specifically defined, various known methods may be employed for mixing the label-constitutive components in the invention. The temperature and the time for mixing them may be suitably determined depending on the properties of the components to be mixed. Dissolved or dispersed in a solvent, the components may be mixed, or they may be directly mixed in melt. In view of the production efficiency, the melt-kneading method is preferred. A powdery or pelletized thermoplastic resin is mixed with an inorganic fine powder and/or an organic filler along with a dispersant, in a Henschel mixer, a ribbon blender, a super-mixer or the like, then melt-kneaded in a double-screw extruder, and extruded out of it into strands, and the resulting resin strands are cut into pellets. Alternatively, the resin melt is extruded out through a strand die into water, and cut with a rotary cutter fitted to the die tip. If desired, a powdery or liquid dispersant or a dispersant dissolved in water or an organic solvent is first mixed with an inorganic fine powder and/or an organic filler, and then this may be mixed with other components including thermoplastic resin.

The label of the invention can be produced by combining various methods known by those skilled in the art. Any resin film produced by any method shall be within the scope of the invention so far as it satisfies the conditions as claimed herein.

For producing the label of the invention, various known film-producing techniques and their combinations may be employed. For example, there are mentioned a casting method of sheetwise extruding a resin melt through a single-layered or multi-layered T-die connected to a screw extruder; a stretching method of stretching a film to form pores therein; a rolling method of rolling a sheet to form pores therein; a calendering method; a foaming method of using a foaming agent; a method of using a porous particles; an inflation method; a solvent extraction method; and a method of dissolving and extracting mixed components. Of those, preferred is the stretching method.

For film stretching, various known methods may be employed. Regarding the stretching temperature, when a non-crystalline resin is used, then it is stretched at a temperature now higher than the glass transition point of the thermoplastic resin to be used; and when a crystalline resin is used, then it is stretched within a temperature range which falls between the glass transition point of the non-crystalline part and the melting point of the crystalline part thereof and which is favorable to the thermoplastic resin. Concretely, the stretching includes machine-direction stretching for which the peripheral speed difference between rolls is utilized; cross-direction stretching to be attained by the use of a tenter oven; rolling; inflation stretching for which a mandrel is used for a tubular film; and co-biaxial stretching to be effected by a combination of a tenter oven and a linear motor.

The draw ratio for the stretching is not specifically defined, and it may be suitably determined in consideration of the use and the object of the resin film of the invention and the properties of the thermoplastic resin used. For example, when a propylene homopolymer or copolymer is used as the thermoplastic resin and when it is stretched in one direction, the draw ratio is generally from 1.2 to 12 times, but preferably from 2 to 10 times. When it is stretched in two directions, then the draw ratio is generally from 1.6 to 60 times as an a real draw ratio, but preferably from 10 to 50 times. When any other thermoplastic resin is used and when it is stretched in one direction, the draw ratio is generally from 1.2 to 10 times, but preferably from 2 to 7 times. When it is stretched in two directions, then the draw ratio is generally from 1.5 to 20 times as an areal draw ratio, but preferably from 4 to 12 times.

If desired, the stretched film may be subjected to heat treatment at high temperatures. The stretching temperature may be lower by from 2 to 160° C. than the melting point of the thermoplastic resin used. When a propylene homopolymer or copolymer is used as a thermoplastic resin, then the stretching temperature is preferably lower by from 2 to 60° C. than the melting point of the polymer, and the stretching speed is preferably from 20 to 350 m/min.

In the invention, a label having the function of sticking to resin containers is used, or a combination of a label and a substance having the function of sticking the label to resin containers is used. One example of the latter is a combination of a label and an adhesive sheet. In the invention, however, preferred is a label having the function of sticking to resin containers by itself. For example, a pressure-sensitive adhesive agent is applied onto the substrate film formed of the above-mentioned resin material to prepare a pressure-sensitive adhesive label, and it may be stuck to shaped containers by the use of an automatic labeling machine. A heat-seal label may also be used, which is prepared by forming a heat-seal resin layer (B) on the substrate film.

The heat-seal label is extremely useful since the formation of resin containers and label sticking thereto can be attained simultaneously in an in-mold process. One preferred embodiment of the heat-seal label of the type is a synthetic paper label produced by forming, on one surface of an inorganic fine powder-containing thermoplastic resin film (the surface to be contacted with resin container), a heat-seal resin layer (B) having a lower melting point than the melting point of the resin material of the film to construct a double-layered film, followed by stretching the double-layered film at a temperature not lower than the melting point of the heat-seal resin but lower than the melting point of the inorganic fine powder-containing thermoplastic resin. Examples of the material to constitute the heat-seal resin layer (B) include low-density or middle-density high-pressure-process polyethylene having a density of from 0.900 to 0.935 g/cm$^3$; straight linear polyethylene having a density of from 0.880 to 0.940 g/cm$^3$; ethylene/vinyl acetate copolymer, ethylene/acrylic acid copolymer, ethylene/alkyl acrylate copolymer, ethylene/alkyl methacrylate copolymer (in which the alkyl group preferably has from 1 to 8 carbon atoms), and metal salt (preferably Zn, Al, Li, K, Na) of ethylene/methacrylic acid copolymer. Preferably, the material of the heat-seal resin is selected in consideration of the resin to constitute the container body. Also preferably, the heat-seal resin layer (B) is embossed for the purpose of preventing the occurrence of blistering during the in-mold process. Any known resin additives may be added to the heat-seal resin layer (B) not detracting from the necessary properties of the layer. Such additives include dye, nucleating agent, plasticizer, lubricant, antioxidant, antiblocking agent, flame retardant, UV absorbent, etc.

The heat-seal resin layer (B) may be formed as follows: A film of heat-seal resin for it is laminated on the substrate layer (A) to form the intended heat-seal resin layer (B) thereon. An emulsion of heat-seal resin, or a resin solution prepared by dissolving heat-seal resin in a solvent such as toluene or ethyl cellosolve is applied onto the substrate layer (A) and then this is dried to form thereon the intended heat-seal resin layer (B).

Preferably, the thickness of the heat-seal resin layer (B) is from 1 to 100 μm, more preferably from 2 to 20 μm. The heat-seal resin layer (B) must melt by the heat of the polyethylene melt or the propylene resin melt that serves as a parison in forming containers, so that the label could be fused to the shaped resin containers. For this, the thickness of the heat-seal resin layer (B) is preferably at least 1 μm. On the other hand, when the thickness of the layer (B) is at most 100 μm, then the label would not curl to make it difficult to attain sheet-type offset printing on the label, and, in addition, the label can be relatively easily fixed on a mold.

The thickness of the label of the invention may be generally from 20 to 250 μm, but preferably from 40 to 200 μm. When the thickness is at least 20 μm, then the label insertion and fixation to the regular position of a mold by the use of a label inserter is easy, and it does not cause a problem of label wrinkling. When the thickness is at most 250 μm, then the area of the notch to be formed in the boundary between the label and the resin container is not so large, and the intended effect is easy to attain.

The substrate layer (A) to constitute the label of the invention may have a multi-layered structure. For example, it may have a two-layered structure of a core layer (A1) and a surface layer (C); or a three-layered structure comprising a core layer (A1) and a surface layer (C) and a back layer (C') formed on both faces of the core layer; or a more multi-layered structure additionally having any other film layer between the core layer (A1) and the surface and back layers.

The substrate layer (A) may be stretched monoaxially or biaxially. When the substrate layer (A) has a multi-layered structure, then it may be a combination of a biaxially-stretched layer and a monoaxially-stretched layer. When a multi-layered structure is stretched, each layer may be separately stretched before laminated, or the laminated layers may be stretched. If desired, the stretched layer may be further stretched after it has been laminated. In addition, after the heat-seal resin layer (B) is formed on the substrate layer (A), the resulting laminate may be stretched as a whole.

By controlling the content of the inorganic fine powder and/or the organic filler and the draw ratio in stretching, the porosity of the label for use in the invention may be controlled. When the label is a transparent or semitransparent label, then its porosity may be from 0% to less than 5%, but preferably from 0.05 to 4%, more preferably from 0.1 to 3.5%. When the label is an opaque label, then its porosity may be from 5 to 70%, but preferably from 7 to 65%, more preferably from 10 to 60%. The porosity as referred to herein is represented by the following formula:

$$\text{Porosity } (\%)=[(\rho 0-\rho)/\rho 0]\times 100$$

wherein $\rho 0$ indicates the true density of the label, and $\rho$ indicates the density of the label.

Preferably, the label for use in the invention has an opacity of from 0 to 100% (according to JIS-Z-8722). Concretely, the transparent or semitransparent label has an opacity of from 0% to less than 70%, but preferably from 0.05 to 50%, more preferably from 0.1 to 30%, even more preferably from 0.2 to 15%. The opaque label has an opacity of from 70 to 100%, but preferably from 80 to 100%, more preferably from 85 to 100%.

The multi-layered label of the invention may have various additional functions such as writability, printability, thermal transferability, scratch resistance, secondary workability.

The label of the invention may be laminated onto at least one surface of a separate thermoplastic film, laminate paper, pulp paper, nonwoven fabric, cloth, wood plate, metal plate or the like to form laminates, and these may also be used in the invention. The separate thermoplastic film on which the label may be laminated may be a transparent or opaque film of, for example, polyester film, polyamide film, polystyrene film or polyolefin film. Like that of the label of the invention, the thickness of the laminate may be generally from 20 to 250 μm, but preferably from 40 to 200 μm.

The surface of the substrate layer (A) may be coated with a pigment-coated layer for improving the printability of the label. The pigment-coated layer may be formed by pigment coating to a base layer, according to an ordinary method of producing coated paper. The pigment coating agent for the pigment coating may be a latex that is used for ordinary coated paper, which comprises from 30 to 80% by weight of a pigment such as clay, talc, calcium carbonate, magnesium carbonate, aluminium hydroxide, silica, calcium silicate or plastic pigment, and from 20 to 70% by weight of an adhesive.

The adhesive to be used for it includes latex such as SBR (styrene-butadiene copolymer rubber), MBR (methacrylate-butadiene copolymer rubber); as well as acrylic emulsion, starch, PVA (polyvinyl alcohol), CMC (carboxymethyl cellulose), methyl cellulose, etc. The composition may further contain a dispersant, for example, a specific sodium carboxylate such as acrylic acid/sodium acrylate copolymer; and a crosslinking agent such as polyamide-urea resin. In general, the pigment-coating agent is used as a water-soluble coating agent having a solid concentration of from 15 to 70% by weight, preferably from 35 to 65% by weight.

The surface of the substrate layer (A) may be processed for activation. The activation treatment may be at least one selected from corona discharge treatment, flame treatment, plasma treatment, glow discharge treatment, and ozone treatment. Preferred are corona treatment and flame treatment. In corona treatment, the treatment dose may be generally from 600 to 12,000 J/m$^2$ (from 10 to 200 W·min/m$^2$), but preferably from 1200 to 9000 J/m$^2$ (from 20 to 150 W·min/m$^2$). When it is at least 600 J/m$^2$ (10 W·min/m$^2$), then the corona discharge treatment effect will be satisfactory, and the thus-processed surface may be free from the problem of repelling in the subsequent step of applying a surface modifier thereto. However, even if higher than 12,000 J/m$^2$ (200 W·min/m$^2$), the effect of the treatment will not be augmented any more. Therefore, the treatment will be enough at 12,000 J/m$^2$ (200 W·min/m$^2$) or lower. The treatment dose in flame treatment may be from 8,000 to 200,000 J/m$^2$, preferably from 20,000 to 100,000 J/m$^2$. When it is at least 8,000 J/m$^2$, then the flame treatment effect will be satisfactory, and the thus-processed surface may be free from the problem of repelling in the subsequent step of applying a surface modifier thereto. However, even if higher than 200,000 J/m$^2$, the effect of the treatment will not be augmented any more. Therefore, the treatment will be enough at 200,000 J/m$^2$ or lower.

After the above-mentioned activation treatment thereof, the surface of the coating layer or the substrate layer (A) may be further coated with a metal layer or an antistatic layer. The antistatic layer formed thereon improves the paper travelability on printers. Examples of the metal to be in the metal layer are aluminium, alumina, gold, silver, copper, zinc, tin, nickel. The metal layer have many advantages in that it improves the barrier property against gas, moisture, light, magnetism, electromagnetic waves and static charging and discharging, and improves the decorative property of the label.

The type and the method of printing on the label are not specifically defined. For example, ink prepared by dispersing a pigment in a known vehicle may be used for printing the label in any known printing method of gravure printing, aqueous flexographic printing, silk screen printing or the like. In addition, the label may also be printed in any other mode of metal vapor deposition, gloss printing or mat printing. The pattern to be printed may be suitably selected from natural patterns such as animals, scenes, cross stripes, polka dots; or abstract patterns.

When the label has a four-sided or more polygonal shape, it is desirable that each corner is chamfered. Concretely, the radius of curvature of each corner may be generally at least 5 mm, but preferably at least 7 mm, more preferably at least 10 mm.

Preferably, the edge profile of the label meets the label face not at a right angle but at an acute angle to reduce the notch area. Concretely, the acute angle is preferably from 5 to 85 degrees, more preferably from 20 to 85 degrees, even more preferably from 30 to 80 degrees.

Preferably, the in-mold label is so fitted to the container that the direction of the label having a lower Gurley stiffness is to be vertical to the breaking direction of the container that breaks owing to the drop impact applied thereto. For example, when the labeled container of FIG. 1 is put on a shelf and when it drops down from the shelf, then the bottom of the container may collide with the floor, and in this case, the label-surrounding part vertical to the bottom of the container may break. In this case, when the in-mold label is so fitted to the container that the direction of the label having a lower Gurley stiffness is to be vertical to the bottom of the container, then it is preferable since the label is stuck to the container in the direction vertical to the breaking direction of the container.

In the invention, the label adhesion strength may be intentionally lowered, not detracting from the effect of the invention and not causing a problem of label peeling during use. When the label adhesion strength is lowered, then the label may be readily peeled away from the used container after the contents of the container have been used up. The case is often favorable from the viewpoint of separating recycling of wastes. Another advantage of this case is that removing the label may be effective for further reducing the volume and the weight of the resin container.

The invention is described more concretely with reference to the following Production Examples, Working Examples and Test Examples. The material, the amount, the blend ratio, the treatment and the process employed in the following Examples may be varied in any desired manner not overstepping the sprit and the scope of the invention. Accordingly, the following Examples are not whatsoever intended to restrict the scope of the invention. In the Production Examples, Working Examples and Test Examples, MFR is measured according to JIS-K-6760; the density is according to JIS-K-7112; the Gurley stiffness is according to NBS-TAPPI T543; and the 3% elongation load is according to JIS-K-7127.

Production Example 1

Production of Label (1)

A resin composition (A1) comprising 67 parts by weight of propylene homopolymer (Nippon Polypro's Novatec PP "MA-8"; m.p., 164° C.), 10 parts by weight of high-density polyethylene (Nippon Polyethylene's Novatec HD "HJ580"; m.p., 134° C.; density, 0.960 g/cm$^3$) and 23 parts by weight of calcium carbonate powder having a particle size of 1.5 μm (shown in Table 1) was melt-kneaded in an extruder, and sheetwise extruded out through a die at 250° C., and the resulting sheet was cooled to about 50° C. Then, the sheet was again heated at about 150° C., and stretched 4-fold in the machine direction by utilizing the peripheral speed difference between rolls to obtain a monoaxially-stretched film.

Apart from it, a resin composition (C) comprising 51.5 parts by weight of propylene homopolymer (Nippon Polypro's Novatec PP "MA-3"; m.p., 165° C.), 3.5 parts by weight of high-density polyethylene (HJ580 mentioned above), 42 parts by weight of calcium carbonate powder having a particle size of 1.5 μm and 3 parts by weight of titanium oxide powder having a particle size of 0.8 μm (shown in Table 1) was melt-kneaded at 240° C. in a different extruder, and filmwise extruded out through a die onto the surface of the above-mentioned MD-stretched film to laminate the two (C/A1) to give a laminate structure of surface layer/core layer.

80 parts by weight of ethylene/1-hexene copolymer (1-hexene content, 22% by weight; degree of crystallinity, 30; number-average molecular weight, 23,000; m.p., 90° C.; MFR, 18 g/10 min; density, 0.898 g/cm$^3$) obtained through copolymerization of ethylene and 1-hexene in the presence of a metallocene/alumoxane catalyst, a type of a metallocene catalyst, and 20 parts by weight of high-pressure-process low-density polyethylene (m.p., 110° C., MFR 4 g/10 min; density 0.92 g/cm$^3$) were melt-kneaded at 200° C. in a double-screw extruder, extruded out through a die into strands, and cut into pellets (B) for heat-seal resin layer (shown in Table 1).

The composition (C) and the pellets (B) for heat-seal resin layer as above were separately melt-kneaded at 230° C. in different extruders, and fed into one co-extrusion die, in which the two were laminated. Then, the resulting laminate (C/B) was filmwise extruded out at 230° C. through a die and laminated onto the side of the A1 layer of the above-mentioned surface layer/core layer laminate (C/A1) in such a manner that the heat-seal resin layer (B) could face outside.

The resulting four-layered film (C/A1/C/B) was led into a tenter oven, heated at 155° C., then stretched 7-fold in the cross direction by the use of the tenter, thereafter heat-set at 164° C., and cooled to 55° C., and its edges were trimmed away. Then, this was subjected to corona discharge treatment at 70 W/m$^2$/min on the side of the surface layer (layer B) thereof, and a four-layered, stretched resin film having a density of 0.77 g/cm$^3$ and an overall thickness of 95 μm (C/A1/C/B=30 μm/35 μm/25 μm/5 μm) was thus obtained. The film had a porosity of 36%. Its Gurley stiffness was 0.03 m·kgf in the MD-stretched direction and 0.09 m·kgf in the CD-stretched direction.

The corners of the film each had a radius of curvature of 5 mm. Using a pillar-shaped blanking cutter having a square cutter profile vertical to the face of the film, the stretched resin film obtained according to the process as above was blanked out to give a label (1).

Production Example 2

Production of Label (2)

In the same manner as in the Production Example for the label (1), a four-layered stretched resin film having a density of 0.77 g/cm$^3$ and an overall thickness of 110 μm (C/A1/C/B=30 μm/50 μm/25 μm/5 μm) was obtained, for which, however, the extrusion rate through the extruders to form the C/A1 laminate was controlled. The film had a porosity of 36%. Its Gurley stiffness was 0.05 m·kgf in the MD-stretched direction and 0.11 m·kgf in the CD-stretched direction. Also in the same manner as in the Production Example for the label (1), this was blanked out to give a label (2).

Production Example 3

Production of Label (3)

A resin composition (A1') comprising 75 parts by weight of propylene homopolymer (Nippon Polypro's Novatec PP "MA-8"; m.p., 164° C.), 10 parts by weight of high-density polyethylene (Nippon Polyethylene's Novatec HD "HJ580"; m.p., 134° C.; density, 0.960 g/cm$^3$) and 15 parts by weight of calcium carbonate powder having a particle size of 1.5 μm (shown in Table 1) was melt-kneaded in an extruder, and sheetwise extruded out through a die at 250° C., and the resulting sheet was cooled to about 50° C. Then, the sheet was again heated at about 158° C., and stretched 4-fold in the machine direction by utilizing the peripheral speed difference between rolls to obtain a monoaxially-stretched film.

Apart from it, the resin composition (C) was melt-kneaded at 240° C. in a different extruder, and filmwise extruded out through a die onto the surface of the above-mentioned MD-stretched film to laminate the two (C/A1') to give a laminate structure of surface layer/core layer.

The composition (C) and the pellets (B) for heat-seal resin layer were separately melt-kneaded at 230° C. in different extruders, and fed into one co-extrusion die, in which the two were laminated. Then, the resulting laminate (C/B) was filmwise extruded out at 230° C. through a die and laminated onto the side of the A1' layer of the above-mentioned surface layer/core layer laminate (C/A1') in such a manner that the heat-seal resin layer (B) could face outside.

The resulting four-layered film (C/A1'/C/B) was led into a tenter oven, heated at 165° C., then stretched 7-fold in the cross direction by the use of the tenter, thereafter heat-set at 168° C., and cooled to 55° C., and its edges were trimmed away. Then, this was subjected to corona discharge treatment at 70 W/m$^2$/min on the side of the surface layer (layer B) thereof, and a four-layered, stretched resin film having a density of 0.94 g/cm$^3$ and an overall thickness of 80 μm (C/A1'/C/B=25 μm/30 μm/20 μm/5 μm) was thus obtained. The film had a porosity of 18%. Its Gurley stiffness was 0.03 m·kgf in the MD-stretched direction and 0.05 m·kgf in the CD-stretched direction. In the same manner as in the Production Example for the label (1), this was blanked out to give a label (3).

Production Example 4

Production of Label (4)

In the same manner as in the Production Example for the label (3), a four-layered stretched resin film having a density of 0.92 g/cm$^3$ and an overall thickness of 100 μm (C/A1'/C/B=25 μm/50 μm/20 μm/5 μm) was obtained, for which, however, the extrusion rate through the extruders to form the C/A1' laminate was controlled. The film had a porosity of 19%. Its Gurley stiffness was 0.06 m·kgf in the MD-stretched direction and 0.11 m·kgf in the CD-stretched direction. In the same manner as in the Production Example for the label (1), this was blanked out to give a label (4).

Production Example 5

Production of Label (5)

Using a multi-layered die with three different extruders fitted thereto, the resin composition (A1) to be a core layer and the resin composition (C) and the heat-seal resin composition (B) both to be outermost layers were laminated in the die to be three layers therein, and then filmwise extruded out, and the resulting sheet was cooled to about 50° C. Then, the sheet was again heated at about 130° C., and stretched 4-fold in the machine direction by utilizing the peripheral speed difference between rolls to obtain a monoaxially-stretched film.

The three-layered film (C/A1/B) was led into a tenter oven, heated at 155° C., then stretched 7-fold in the cross direction by the use of the tenter, thereafter heat-set at 160° C., and cooled to 55° C., and its edges were trimmed away. Then, this was subjected to corona discharge treatment at 70 W/m$^2$/min on the side of the surface layer (layer C) thereof, and a three-layered, stretched resin film having a density of 0.72 g/cm$^3$ and an overall thickness of 100 μm (C/A1/B=25 μm/70 μm/5 μm) was thus obtained. The film had a porosity of 36%. Its Gurley stiffness was 0.02 m·kgf in the MD-stretched direction and 0.06 m·kgf in the CD-stretched direction. In the same manner as in the Production Example for the label (1), this was blanked out to give a label (5).

Production Example 6

Production of Label (6)

In the process of the Production Example for the label (5), the unstretched sheet was reheated at about 140° C. and then stretched 4-fold in the machine direction by utilizing the peripheral speed difference between rolls to obtain a monoaxially-stretched film. This was heated at 160° C., then stretched 7-fold in the cross direction by the use of a tenter, thereafter heat-set at 165° C., and cooled to 55° C., and its edges were trimmed away. Then, this was subjected to corona discharge treatment at 70 W/m$^2$/min on the side of the surface layer (layer C) thereof, and a three-layered, stretched resin film having a density of 0.83 g/cm$^3$ and an overall thickness of 100 μm (C/A1/B=25 μm/70 μm/5 μm) was thus obtained. The film had a porosity of 25%. Its Gurley stiffness was 0.09 m·kgf in the MD-stretched direction and 0.12 m·kgf in the CD-stretched direction. In the same manner as in the Production Example for the label (1), this was blanked out to give a label (6).

Production Example 7

Production of Label (7)

In the process of the Production Example for the label (5), the extrusion rate through the extruders to form the C/A1 laminate was controlled. Then, the unstretched sheet was reheated at about 120° C., stretched 4-fold in the machine direction by utilizing the peripheral speed difference between rolls, and cooled to 55° C., and the edges of the resulting sheet were trimmed away. This was subjected to corona discharge treatment at 70 W/m$^2$/min on the side of the surface layer (layer B) thereof, and a three-layered, monoaxially-stretched resin film having a density of 0.83 g/cm$^3$ and an overall thickness of 80 μm (C/A1/B=25 μm/50 μm/5 μm) was thus obtained. The film had a porosity of 26%. Its Gurley stiffness was 0.04 m·kgf in the MD-stretched direction and 0.01 m·kgf in the non-stretched direction. In the same manner as in the Production Example for the label (1), this was blanked out to give a label (7).

Production Example 8

Production of Label (8)

In the same manner as in the Production Example for the label (7), a three-layered, monoaxially-stretched resin film having a density of 0.83 g/cm$^3$ and an overall thickness of 130 μm (C/A1/B=25 μm/100 μm/5 μm) was obtained, for which, however, the extrusion rate through the extruders to form the C/A1 laminate was controlled. The film had a porosity of 25%. Its Gurley stiffness was 0.05 m·kgf in the MD-stretched direction and 0.02 m·kgf in the non-stretched direction. In the same manner as in the Production Example for the label (1), this was blanked out to give a label (8).

Production Example 9

Production of Label (9)

Using a two-layered die with two different extruders fitted thereto, the resin composition (A1) and the heat-seal resin composition (B) to be outermost layer were laminated in the die to be two layers therein, and then filmwise extruded out, and the resulting sheet was cooled to about 50° C. Then, this was subjected to corona discharge treatment at 70 W/m$^2$/min on the side of the surface layer (layer A1) thereof, and a two-layered, unstretched resin film having a density of 1.06 g/cm$^3$ and an overall thickness of 80 μm (A1/B=75 μm/5 μm) was thus obtained. The Gurley stiffness of the film was 0.01 m·kgf. In the same manner as in the Production Example for the label (1), this was blanked out to give a label (9).

Production Example 10

Production of Label (10)

In the process of the Production Example for the label (1), the resin film was blanked out with a pillar-shaped blanking cutter having a square cutter profile that meets the face of the film at an acute angle, and a label (10) was thus obtained.

Production Example 11

Production of Label (11)

In the process of the Production Example for the label (2), the resin film was blanked out with a pillar-shaped blanking cutter having a square cutter profile that has a radius of curvature of the corner of 0 mm, and a label (11) was thus obtained.

Production Example 12

Production of Label (12)

A resin composition (A1") comprising 49 parts by weight of propylene homopolymer (Nippon Polypro's Novatec PP "MA-3"; m.p., 164° C.), 5 parts by weight of high-density polyethylene (Nippon Polyethylene's Novatec HD "HJ580"; m.p., 134° C.; density, 0.960 g/cm$^3$), 1 part by weight of calcium carbonate powder having a particle size of 1.5 μm, and 45 parts by weight of high-pressure-process low-density polyethylene (m.p., 110° C.; MFR, 4 g/10 min; density, 0.92 g/cm$^3$) (shown in Table 1) was melt-kneaded in an extruder, and sheetwise extruded out through a die at 230° C., and the resulting sheet was cooled to about 50° C. Then, the sheet was again heated at about 140° C., and stretched 4-fold in the machine direction by utilizing the peripheral speed difference between rolls to obtain a monoaxially-stretched film.

A part from it, a resin composition (C') comprising 49 parts by weight of propylene homopolymer (Nippon Polypro's Novatec PP "MA-3"; m.p., 164° C.), 5 parts by weight of high-density polyethylene (Nippon Polyethylene's Novatec HD "HJ580"; m.p., 134° C.; density, 0.960 g/cm$^3$), 1 part by weight of calcium carbonate powder having a particle size of 1.5 μm, and 45 parts by weight of high-pressure-process low-density polyethylene (m.p., 110° C.; MFR, 4 g/10 min; density, 0.92 g/cm$^3$) (shown in Table 1) was melt-kneaded at 240° C. in a different extruder, and film wise extruded out through a die onto the surface of the above-mentioned MD-stretched film to laminate the two (C'/A1") to give a laminate structure of surface layer/core layer.

The composition (C') and the pellets (B) for heat-seal resin layer as above were separately melt-kneaded at 230° C. in different extruders, and fed into one co-extrusion die, in which the two were laminated. Then, the resulting laminate was filmwise extruded out at 230° C. through a die and laminated onto the side of the core layer of the above-mentioned surface layer/core layer laminate (C'/A1") in such a manner that the heat-seal resin layer (B) could face outside.

The resulting four-layered film (C'/A1"/C'/B) was led into a tenter oven, heated at 160° C., then stretched 7-fold in the cross direction by the use of the tenter, thereafter heat-set at 165° C., and cooled to 55° C., and its edges were trimmed away. Then, this was subjected to corona discharge treatment at 70 W/m$^2$/min on the side of the surface layer (layer B) thereof, and a four-layered, stretched porous resin film having a density of 0.95 g/cm$^3$ and an overall thickness of 80 μm (C'/A1"/C'/B=25 μm/30 μm/20 μm/5 μm) was thus obtained. The film had a porosity of 0.5%. Its Gurley stiffness was 0.01 m·kgf in the MD-stretched direction and 0.02 m·kgf in the CD-stretched direction. In the same manner as in the Production Example for the label (1), this was blanked out to give a label (12).

Production Example 13

Production of Label (13)

In the process of the Production Example for the label (1), the resin film was blanked out with a pillar-shaped blanking cutter having a square cutter profile that has a radius of curvature of the corner of 12 mm, and a label (13) was thus obtained.

Production Example 14

Production of Label (14)

In the process of the Production Example for the label (5), the resin film was blanked out with a pillar-shaped blanking cutter having a square cutter profile that has a radius of curvature of the corner of 25 mm, and a label (14) was thus obtained.

EXAMPLES 1 TO 9, COMPARATIVE EXAMPLES 1 TO 6

High-density polyethylene (Nippon Polyethylene's Novatec HD "HB330", having a melt flow rate at 190° C. and under a load of 2.16 kg of 0.35 g/10 min, and a density of 0.953 g/cm$^3$) was used as the material for containers. A 3-liter container mold was used. In a large-size direct low-molding machine (Tahara's TPF-706B), single-layered resin containers of Examples 1 to 9 and Comparative Examples 1 to 6 were molded, in which the parison temperature was 200° C., the empty container weight was 120 g, and the lip-to-lip distance of the die was controlled for parison control. In Examples 1 to 9 and Comparative Examples 2 to 6, the in-mold label was so stuck to each sample that its direction having a lower Gurley stiffness could be vertical to the breaking direction of the container in which the container would break by drop impact. As opposed to these, in Comparative Example 1, the in-mold label was so stuck to the sample that its direction having a higher Gurley stiffness could be vertical to the breaking direction of the container in which the container would break by drop impact.

The label was selected as in Table 2, and it was inserted into the split parts of the mold by the use of an automatic inserter in such a manner that it could be in the body site of the inner face of the mold cavity. Through the suction hole fitted to the mold, the label was fixed on the inner face of the mold. In an in-mold process in that condition, labeled resin container were produced.

Thus obtained, the resin containers were analyzed in point of the Gurley stiffness thereof in the labeled area and the non-labeled area around the label. Concretely, the empty resin container was cut into a test piece having a predetermined size. Using a Gurley stiffness tester (Toyo Seiki Seisakusho's Gurley-type Stiffness Tester) in a temperature-controlled room at 23° C., the Gurley stiffness of the test piece was measured in the direction thereof vertical to the breaking direction of the container in which the container would break by drop impact. The results are given in Table 2.

In addition, the resin containers were further analyzed in point of the 3% elongation load thereof in the labeled area and the non-labeled area around the label. Concretely, the empty resin container was cut into a test piece having a predetermined size. Using a tensile tester (Shimadzu Seisakusho's Autograph AGS-D Model) in a temperature-controlled room at 23° C., the test piece pulled at a pulling rate of 20 mm/min and its 3% elongation load was measured in the direction thereof vertical to the breaking direction of the container in which the container would break by drop impact. The results are given in Table 2.

Further, the cross-section area of the notch to occur in the boundary between the label and the resin container was measured as follows: In the practicability test for drop impact resistance mentioned below, the cross-section area of the notch at the broken site of the sample was determined through observation with a microscope. Concretely, the boundary between the label and the resin container was cut with a cutter in the direction vertical to the notch direction, and the resulting cross section was photographed with a 70-power optical microscope. In the image of the picture, the cross-section area of the notch was measured. The results are given in Table 2.

The resin containers obtained herein were evaluated in point of their practicability for drop impact resistance. Concretely, 2 days after the production of the in-mold labeled containers, the containers were filled with tap water up to the shoulder thereof, and stored in an oven at 25° C. for 2 days. Water charging and dropping test immediately after the production of the containers could not give stable data and the data in the test may greatly fluctuate since the resin crystallinity could not be stabilized as yet. Therefore, in this, the containers were tested after a predetermined period of time. The containers were stored at the predetermined temperature. This is because the water temperature may have some influence on the data of the containers.

The resin containers filled with water were spontaneously dropped from a height of 1 m with their mouth kept upward. In that condition, every container was dropped repeatedly, and the number of dropping times with safety without breakage was counted for each container. The samples thus tested were evaluated according to the criteria mentioned below. In every case, 10 containers were tested, and their data were averaged. The results are given in Table 2.

OO: Broken after dropped 10 times or more.

O: Broken after dropped from 5 to 9 times.

x: Broken after dropped from 2 to 4 times.

xx: Broken when dropped once.

TABLE 1

| | Resin | | | | | Inorganic Fine Powder | |
|---|---|---|---|---|---|---|---|
| | Propylene Homopolymer | | High-Density Polyethylene | Ethylene/ 1-Hexene | Low-Density | Calcium Carbonate Powder (particle | Titanium Oxide Powder (particle |
| | Type | Amount | (HJ580) | Copolymer | Polyethylene | size, 1.5 μm) | size, 0.8 μm) |
| Resin Composition (A1) | MA-8 | 67 wt. pts | 10 wt. pts | — | — | 23 wt. pts | — |
| Resin Composition (C) | MA-3 | 51.5 wt. pts | 3.5 wt. pts | — | — | 42 wt. pts | 3 wt. pts |
| Pellets (B) for heat-seal resin layer | — | — | — | 80 wt. pts | 20 wt. pts | — | — |
| Resin Composition (A1') | MA-8 | 75 wt. pts | 10 wt. pts | — | — | 15 wt. pts | — |
| Resin Composition (A1'') | MA-3 | 49 wt. pts | 5 wt. pts | — | 45 wt. pts | 1 wt. pt | — |
| Resin Composition (C') | MA-3 | 49 wt. pts | 5 wt. pts | — | 45 wt. pts | 1 wt. pt | — |

TABLE 2

| | Test Items | Unit | Example 1 | Example 2 | Example 3 | Example 4 | Example 5 | Example 6 | Example 7 | Example 8 |
|---|---|---|---|---|---|---|---|---|---|---|
| Label | Label | — | (1) | (3) | (5) | (7) | (9) | (10) | (12) | (1) |
| | Thickness | μm | 95 | 80 | 100 | 80 | 80 | 95 | 80 | 95 |
| | Density | g/cm$^3$ | 0.77 | 0.94 | 0.72 | 0.83 | 1.06 | 0.77 | 0.95 | 0.77 |
| | Porosity | % | 36 | 18 | 36 | 26 | 0 | 36 | 0.5 | 36 |
| | Opacity | % | 96 | 87 | 98 | 90 | 70 | 96 | 5 | 96 |
| | Radius of Curvature of Corner | mm | 5 | 5 | 5 | 5 | 5 | 5 | 5 | 12 |
| | edge profile | — | right angle | right angle | right angle | right angle | right angle | acute angle | right angle | right angle |
| Labeled Part | Gurley Stiffness | m · kgf | 16 | 16 | 17 | 15 | 13 | 16 | 10 | 16 |
| | 3% Elongation Load | kgf | 8 | 9 | 8 | 9 | 8 | 8 | 8 | 8 |
| | Mechanical Strength A | m · kgf$^2$ | 128 | 144 | 136 | 135 | 104 | 128 | 80 | 128 |
| Non-Labeled Part | Gurley Stiffness | m · kgf | 15 | 15 | 15 | 15 | 15 | 15 | 15 | 15 |
| | 3% Elongation Load | kgf | 18 | 18 | 18 | 18 | 18 | 18 | 18 | 18 |
| | Mechanical Strength B | m · kgf$^2$ | 270 | 270 | 270 | 270 | 270 | 270 | 270 | 270 |
| A/B | | — | 0.47 | 0.53 | 0.50 | 0.50 | 0.39 | 0.47 | 0.30 | 0.47 |
| Notch Cross-Section Area A | | $10^4$ μm$^2$ | 1.3 | 0.9 | 1.5 | 0.9 | 0.9 | 0.6 | 0.9 | 1.3 |
| (A/B) × S | | $10^4$ μm$^2$ | 0.6 | 0.5 | 0.8 | 0.5 | 0.4 | 0.3 | 0.3 | 0.6 |
| Drop Impact Resistance Test | | — | O | O | O | O | O | OO | OO | OO |

| | Test Items | Unit | Example 9 | Com. Ex. 1 | Com. Ex. 2 | Com. Ex. 3 | Com. Ex. 4 | Com. Ex. 5 | Com. Ex. 6 |
|---|---|---|---|---|---|---|---|---|---|
| Label | Label | — | (5) | (1) | (2) | (4) | (6) | (8) | (11) |
| | Thickness | μm | 100 | 95 | 110 | 100 | 100 | 130 | 110 |
| | Density | g/cm$^3$ | 0.72 | 0.77 | 0.77 | 0.92 | 0.83 | 0.83 | 0.77 |
| | Porosity | % | 36 | 36 | 36 | 19 | 25 | 25 | 36 |
| | Opacity | % | 98 | 96 | 90 | 89 | 93 | 98 | 90 |
| | Radius of Curvature of Corner | mm | 25 | 5 | 5 | 5 | 5 | 5 | 0 |
| | edge profile | — | right angle | right angle | right angle | right angle | right angle | right angle | right angle |
| Labeled Part | Gurley Stiffness | m · kgf | 17 | 20 | 19 | 19 | 18 | 17 | 19 |
| | 3% Elongation Load | kgf | 8 | 13 | 9 | 9 | 12 | 10 | 9 |
| | Mechanical Strength A | m · kgf$^2$ | 136 | 260 | 171 | 171 | 216 | 170 | 171 |
| Non-Labeled Part | Gurley Stiffness | m · kgf | 15 | 15 | 15 | 15 | 15 | 15 | 15 |
| | 3% Elongation Load | kgf | 18 | 18 | 18 | 18 | 18 | 18 | 18 |
| | Mechanical Strength B | m · kgf$^2$ | 270 | 270 | 270 | 270 | 270 | 270 | 270 |
| A/B | | — | 0.50 | 0.96 | 0.63 | 0.63 | 0.80 | 0.63 | 0.63 |
| Notch Cross-Section Area A | | $10^4$ μm$^2$ | 1.5 | 1.3 | 1.7 | 1.5 | 1.5 | 2.5 | 1.7 |
| (A/B) × S | | $10^4$ μm$^2$ | 0.8 | 1.2 | 1.1 | 1.0 | 1.2 | 1.6 | 1.1 |
| Drop Impact Resistance Test | | — | OO | x | x | x | x | x | xx |

INDUSTRIAL APPLICABILITY

The in-mold labeled thermoplastic resin container of the invention is specifically so designed that the ratio of the product A of the Gurley stiffness (m·kgf) and the 3% elongation load (kgf) of the label-edge part of the labeled area thereof to the product B of the Gurley stiffness and the 3% elongation load of the label-surrounding part of the non-labeled area thereof, A/B, is at most 0.6. The container is lightweight and has good producibility, and it is improved in point of the drop impact fracture resistance thereof.

The present disclosure relates to the subject matter contained in PCT/JP2004/008558 filed on Jun. 11, 2004, which is expressly incorporated herein by reference in its entirety.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined claims set forth below.

The invention claimed is:

1. An in-mold labeled resin container comprising:

a thermoplastic resin container body having a labeled area and a non-labeled area, the labeled area comprising a label integrally fitted to the thermoplastic resin container body and having a label-edge part, the non-labeled area having a label-surrounding part, the thermoplastic resin container body having a volume which is from 1.5 liters to 300 liters, wherein the label-edge part of the labeled area has a product A of Gurley stiffness (m·kgf) and a 3% elongation load (kgf), the label-surrounding part of the non-labeled area has a product B of Gurley stiffness and a 3% elongation load, and the product A and the product B has a ratio, A/B, which is from 0.05 to 0.6, wherein the label is fitted to the thermoplastic resin container body such that a lower Gurley stiffness direction of the label is arranged to be vertical with respect to a bottom of the container when the bottom of the container is horizontal, wherein the label has a thermoplastic resin-containing substrate layer and a heat-seal resin layer formed on one surface of the thermoplastic resin-containing substrate layer, and the label is integrally fitted to the thermoplastic resin container body via the heat-seal resin layer, wherein the thermoplastic resin-containing substrate layer comprises a stretched resin film that contains from 30 to 100% by weight of a thermoplastic resin and from 0 to 70% of at least one of an inorganic fine powder and an organic filler, and wherein the label has a plurality of corners each of which has a radius of curvature of at least 5 mm.

2. The in-mold labeled resin container as claimed in claim 1, wherein the ratio, A/B, is at most 0.55.

3. The in-mold labeled resin container as claimed in claim 1, wherein the ratio, A/B, and a cross-sectional area S ($\mu m^2$) of a notch occurring in a boundary between the label and the thermoplastic resin container body, has a product, (A/B)×S, which is less than $1.0\times10^4$ $\mu m^2$.

4. The in-mold labeled resin container as claimed in claim 1, wherein the thermoplastic resin container body comprises a polyolefin-based resin.

5. The in-mold labeled resin container as claimed in claim 4, wherein the polyolefin-based resin comprises a polyethylene-based resin or a polypropylene-based resin.

6. The in-mold labeled resin container as claimed in claim 1, wherein the thermoplastic resin-containing substrate layer is monoaxially stretched.

7. The in-mold labeled resin container as claimed in claim 1 wherein the thermoplastic resin-containing substrate layer is biaxially stretched.

8. The in-mold labeled resin container as claimed in claim 1, wherein the thermoplastic resin-containing substrate layer is a combination of a biaxially-stretched layer and a monoaxially-stretched layer.

9. The in-mold labeled resin container as claimed in claim 6, wherein the heat-seal resin layer is stretched at least one direction.

10. The in-mold labeled resin container as claimed in claim 6, wherein the label has an opacity which is from 70 to 100%.

11. The in-mold labeled resin container as claimed in claim 6, wherein the label has an opacity which is from 0 to less than 70%.

12. The in-mold labeled resin container as claimed in claim 6, wherein the heat-seal resin layer is formed in a coating method.

13. The in-mold labeled resin container as claimed in claim 6, wherein the surface of the thermoplastic resin-containing substrate layer is coated with at least one of a coating layer and a metal layer.

14. The in-mold labeled resin container as claimed in claim 6, wherein the label has a print layer.

15. The in-mold labeled resin container as claimed in claim 1, wherein the heat-seal resin layer is embossed.

16. The in-mold labeled resin container as claimed in claim 1, wherein the label comprises a polyolefin-based resin.

17. The in-mold labeled resin container as claimed in claim 1, wherein the label has an edge profile which meets a face of the label at an acute angle to reduce a notch area.

* * * * *